US011114071B2

(12) United States Patent
Hashimoto et al.

(10) Patent No.: US 11,114,071 B2
(45) Date of Patent: Sep. 7, 2021

(54) PERCUSSION INSTRUMENT

(71) Applicant: YAMAHA CORPORATION, Hamamatsu (JP)

(72) Inventors: Ryuji Hashimoto, Hamamatsu (JP); Noritaka Nagai, Hamamatsu (JP); Banri Abe, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/397,170

(22) Filed: Apr. 29, 2019

(65) Prior Publication Data

US 2019/0251934 A1 Aug. 15, 2019

Related U.S. Application Data

(63) Continuation of application No. PCT/JP2017/038631, filed on Oct. 26, 2017.

(30) Foreign Application Priority Data

Nov. 2, 2016 (JP) ..... JP2016-214856
Mar. 2, 2017 (JP) ..... JP2017-039294

(51) Int. Cl.
*G10D 13/10* (2020.01)
*G10D 13/02* (2020.01)
(Continued)

(52) U.S. Cl.
CPC ..... *G10D 13/10* (2020.02); *G10D 13/00* (2013.01); *G10D 13/02* (2013.01); *G10D 13/22* (2020.02)

(58) Field of Classification Search
CPC ..... G10D 13/10; G10D 13/22; G10D 13/02; G10D 13/00
See application file for complete search history.

(56) References Cited

U.S. PATENT DOCUMENTS 4,903,569 A 2/1990 Kurosaki
6,291,752 B1 9/2001 Vergara
(Continued)

FOREIGN PATENT DOCUMENTS

FR 3021802 A1 * 12/2015 ..... G10D 13/023
JP H0622880 Y2 6/1994
(Continued)

OTHER PUBLICATIONS

International Search Report issued in Intl. Appln. No. PCT/JP2017/038631 dated Dec. 19, 2017. English translation provided.
(Continued)

*Primary Examiner* — Kimberly R Lockett
(74) *Attorney, Agent, or Firm* — Rossi, Kimms & McDowell LLP

(57) ABSTRACT

Provided is a percussion instrument including a substantially cylindrical barrel and a weight fixed to the barrel. More specifically, a plurality of weights 5A to 5D may be provided on the inner circumferential surface of a shell 2 of a drum 1 (a percussion instrument). The weights 5A to 5D may be provided at positions where the weights 5A to 5D have four-fold rotational symmetry in the circumferential direction of the shell 2. The weights 5A to 5D may be each provided between lugs 3 that are provided adjacent to each other on the outer circumferential surface of the shell 2.

15 Claims, 11 Drawing Sheets

(51) Int. Cl.
*G10D 13/00* (2020.01)
*G10D 13/22* (2020.01)

(56) References Cited

U.S. PATENT DOCUMENTS

| | | | |
|---|---|---|---|
| 2010/0037749 | A1 | 2/2010 | Brunson |
| 2010/0083812 | A1 | 4/2010 | Peavey |

FOREIGN PATENT DOCUMENTS

| | | | | | |
|---|---|---|---|---|---|
| JP | 2522735 | Y2 | | 1/1997 | |
| JP | H11119770 | A | | 4/1999 | |
| JP | 003140394 | U | * | 3/2008 | ..... G10D 13/00 |
| JP | 3140394 | U | | 3/2008 | |

OTHER PUBLICATIONS

Written Opinion Search Report issued in Intl. Appln. No. PCT/JP2017/038631 dated Dec. 19, 2017.
"WT40". YAMAHA. Web. Searched on Oct. 5, 2016. URL:http://jp.yamaha.com/products/musical-instruments/drums/accessories/weights/. Cited in Specification. English translation of explanation provided.
"Reflection Plate PR-670/4". Pearl Musical Instrument Co. Web. Searched on Jan. 23, 2017. URL:http://www.pearlgakki.com/drum/PR_670_4.php. Cited in Specification. English translation of explanation provided.
Office Action issued in Japanese Appln. No. 2018-548963 dated Jul. 7, 2020. English translation provided.
Extended European Search Report issued in European Appln. No. 17867652.4 dated May 19, 2020.

* cited by examiner

PERCUSSION INSTRUMENT

CROSS REFERENCE TO RELATED APPLICATIONS

The present application is a continuation application of International Application No. PCT/JP2017/038631, filed Oct. 26, 2017, which claims priorities to Japanese Patent Application No. 2016-214856, filed Nov. 2, 2016 and Japanese Patent Application No. 2017-39294, filed Mar. 2, 2017. The contents of these applications are incorporated herein by reference in their entirety.

FIELD OF INVENTION

The present invention relates to a percussion instrument (a drum) such as a bass drum.

BACKGROUND

Non-patent Literature 1 shows a weight that can be used for various purposes in, for example, a bass drum, which is a percussion instrument. A weight according to Non-patent Literature 1 is an approximately 4 kg weight that has a plate-like shape. This weight is placed in a substantially cylindrical barrel (shell) of a bass drum, for example.

Also, some musicians put a duvet, a blanket, or the like in the shell of a bass drum, and place a plate-shaped weight or the like on the duvet or the like. The weight according to Non-patent Literature 1 may be used as this plate-shaped weight. In this mode, a portion of the duvet or the like comes into contact with the drumhead. Therefore, drum sound can be muted. Also, by placing a plate-shaped weight or the like on the duvet or the like, it is possible to prevent the duvet or the like from moving away from the drumhead due to vibrations of the drumhead.

Also, conventionally, an additional part may be attached to the shell in order to change or improve the tone of drum sound. For example, according to Non-patent Literature 2, resonating stainless steel plates are attached to lug attachment holes provided in the inner surface of the shell, and thus the unique shape of the resonating plates renders the reflection of sound in the shell complex, which realizes a distinctive tone. Also, according to US 2010/0083812 (hereinafter called Patent Literature 1), blade-shaped plates are attached to the inner surface of the shell to control reflected sound in the shell, and thus the resonance properties of the drum is improved.

NON-PATENT LITERATURES

Non-patent Literature 1: "WT40", [online], YAMAHA, [Searched on Oct. 5, 2016], the Internet, <URL:http://jp.yamaha.com/products/musical-instruments/drums/accessories/weights/>

Non-patent Literature 2: "Reflection Plate PR-670/4", [online], Pearl Musical Instrument Co. [Searched on Jan. 23, 2017], the Internet, <URL:http://www.pearlgakki.com/drum/PR_670_4.php>

SUMMARY OF THE INVENTION

In recent years, there is demand that various kinds of drums such as bass drums and snare drums produce high-quality drum sound. High-quality drum sound is, for example, sound with a clear low tone.

In this regard, it is reportedly possible to improve the quality of drum sound by placing the weight according to Non-patent Literature 1 inside the shell of a bass drum. However, using only one weight according to Non-patent Literature 1 does not necessarily achieve a sufficient effect of improving the drum sound quality.

Therefore, to improve the drum sound quality using a weight according to Non-patent Literature 1, many weights are to be placed in the shell. However, if many weights are placed in the shell, the bass drum will be too heavy, and it will be difficult to handle the bass drum. Also, it is troublesome to handle many weights.

Also, although Non-patent Literature and Patent Literature 1 render the tone distinctive, it cannot be expected that they improve the sound quality, such as by rendering a low tone clear. Note that, if special processing is applied to a drum or a dedicated mechanism is provided in a drum to improve sound quality, such an improvement will not be applicable to existing drums. Therefore, general versatility needs to be ensured.

The present invention has been made to solve the problem with the above-described conventional technology, and aims to provide a percussion instrument that is applicable to existing percussion instruments to improve sound quality.

To fulfill the above-described aim, the present invention provides a percussion instrument that is characterized by a substantially cylindrical barrel to which a weight is fixed.

In a preferable mode, the weight of the present percussion instrument is provided as a plurality of the weights, and the present percussion instrument is characterized in that the plurality of weights are fixed to the barrel at intervals in the circumferential direction of the barrel.

In a more preferable mode, the present percussion instrument is characterized in that the percussion instrument includes a functional part that is attached to the barrel; and a fastening member for attaching the functional part to the barrel, and in a state where the functional part is attached to the barrel using the fastening member, the weight is fixed to either one or both of the functional part and the fastening member.

According to the present invention, it is possible to obtain high-quality drum sound with an acoustically clear low tone. Presumably, this is for the following reasons. In a drum according to this invention, weights are fixed to the shell. Therefore, in the present drum, the shell and the weights are integrated into one piece, and the overall mass of the shell is greater than that of a typical shell. When an operation to play (hit) the drum is performed, the shell vibrates in response to the drumhead vibrating. When the shell in a stationary state starts vibrating, the shell has a tendency to remain in the stationary state due to inertia. The tendency to remain in a stationary state increases as the mass of the shell increases. Therefore, in the present drum having a shell with an increased mass, the vibration of the shell is suppressed in a frequency range around the fundamental tone of the drum sound. As a result of the vibration of the shell being suppressed, energy applied to the drum through an operation performed to play the drum is consumed less by the vibration of the shell while it is consumed more by the vibration of the drumhead. Therefore, in the present drum, the drumhead vibrates more in a frequency range around the fundamental tone, and produces the fundamental tone with increased sustain. The fundamental tone with increased sustain leads to a clearer low tone. Therefore, with the present drum, it is possible to obtain high-quality drum sound.

In a mode in which the weight according to Non-patent Literature 1 is placed in the shell, the shell and the weight are not integrated into one piece, and the weight presumably does not produce a sufficient effect of keeping the shell in a stationary state. For example, although the weight can act in an attempt to keep the shell in a stationary state when the shell and the weight move upward in the vertical direction, the weight cannot act in an attempt to keep the shell in a stationary state when the shell and the weight move downward in the vertical direction. Therefore, in a mode in which the weight according to Non-patent Literature 1 is placed in the shell, the vibration of the shell cannot be sufficiently suppressed in a frequency range around the fundamental tone of the drum sound, and the effect of improving the drum sound quality is not sufficiently produced.

In contrast, in the present drum, the shell and the weight are integrated into one piece as described above. As a result, for example, the weight of the present drum can act in an attempt to keep the shell in a stationary state both when the shell and the weight move upward in the vertical direction and when they move downward in the vertical direction. Therefore, compared to a mode in which the weight according to Non-patent Literature 1 is placed in the shell, the vibration of the shell in a frequency range around the fundamental tone is sufficiently suppressed. Therefore, with the present drum, the fundamental tone has even more sustain than that in the mode in which the weight according to Non-patent Literature 1 is placed in the shell. Thus, it is possible to obtain drum sound with higher quality. Also, with the present drum, the mass of the weight can be smaller than that of the weight according to Non-patent Literature 1.

Also, in the shell that vibrates in response to an operation performed to play the drum, a portion that instantaneously moves inward of the shell and a portion that instantaneously moves outward of the shell alternatingly appear in the circumferential direction of the shell. The number of such repetitive appearances in the circumferential direction of the shell increases as the order of the vibration mode of the shell increases. In the present drum, a plurality of weights are fixed at intervals in the circumferential direction of the shell. By providing intervals in the circumferential direction of the shell, it is possible to fix the weights respectively to portions that move inward or outward of the shell and that alternatively appear in the circumferential direction of the shell (i.e. portions corresponding to the antinodes of the vibration of the shell in the vibration mode of the shell). At such portions corresponding to the antinodes of the vibration of the shell, once vibration starts, the vibration is sustained due to inertia. The extent to which the vibration is sustained increases as the mass of the portions increases. Therefore, in the present drum in which a plurality of weights are fixed to the shell so as to be dispersed in the circumferential direction of the shell, the vibration of the shell is sustained in certain frequency bands of the drum sound (specifically, the frequency bands of high order-side harmonics of the fundamental tone). As a result of the vibration of the shell being sustained, energy applied to the drum through an operation performed to play the drum is consumed more by the vibration of the shell while it is consumed less by the vibration of the drumhead. For this reason, with the present drum, the vibration of the drumhead decreases in the frequency bands of high order-side harmonics of the fundamental tone, and the sustain of high order-side harmonics of the fundamental tone decreases. Therefore, the present drum produces the fundamental tone with increased sustain, and high order-side harmonics of the fundamental tone with reduced sustain, and thus realizes drum sound with higher quality in which the fundamental tone is clearer and more distinctive.

In the mode in which the weight according to Non-patent Literature 1 is placed in the shell, the weight is provided only on the ground side in the shell, and no weights are dispersed in the circumferential direction of the shell. Therefore, the sustain of high order-side harmonics presumably does not decrease. In contrast, with the present drum, it is possible to reduce the sustain of high order-side harmonics as described above. From this point of view also, with the present drum, it is possible to obtain drum sound with higher quality than that in a mode in which the weight according to Non-patent Literature 1 is placed in the shell.

DETAILED DESCRIPTION OF THE PREFERRED EMBODIMENTS

The following describes embodiments of the present invention with reference to the drawings.

Figure 1:
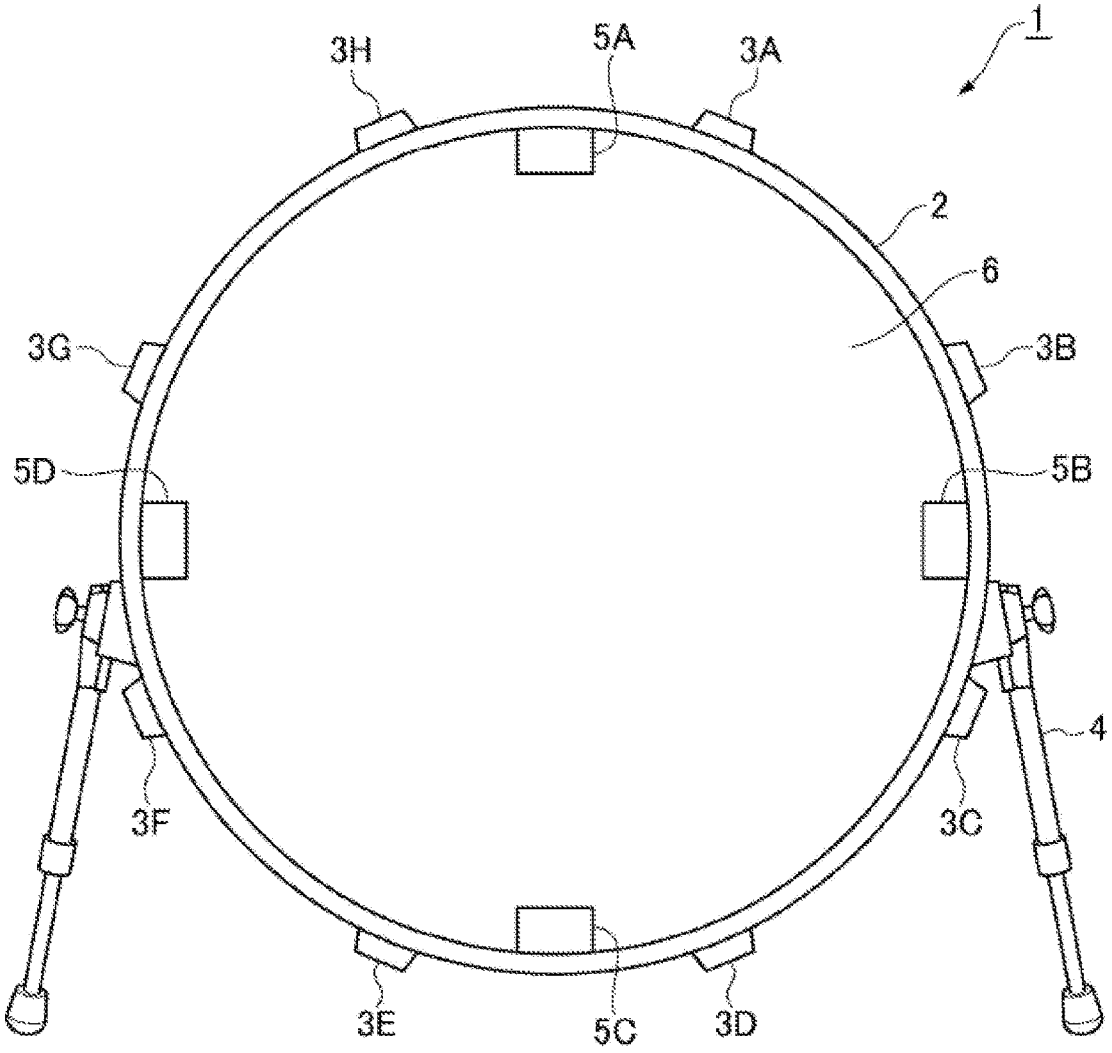
FIG. 1 is a front view showing a configuration of a drum 1 that is a first embodiment of the present invention.

First, the following describes a drum that is a percussion instrument that is a first embodiment of the present invention. FIG. 1 is a front view showing a configuration of a drum 1 that is the first embodiment of the present invention. The drum 1 is a bass drum. The drum 1 includes a barrel (shell) 2 that has a cylindrical shape with two open ends, eight lugs 3A to 3H, two legs 4, and four weights 5A to 5D. When the lugs 3A to 3H are not distinguished from each other, they are denoted as lugs 3, and when the weights 5A to 5D are not distinguished from each other, they are denoted as weights 5. FIG. 1 shows a state before a drumhead is attached to an open end of the shell 2. Although the drumhead is omitted from FIG. 1, the drumhead is stretched over an open end of the shell 2 when the drum 1 is used.

The opening diameter of the open end of the shell 2 is 22 inches, for example. The shell 2 is placed in an orientation in which a plane that includes the open end is orthogonal to the ground (in other words, an orientation in which the normal of the drumhead stretched over an open end is parallel to the ground). In such a state, the shell 2 is supported by the legs 4, which are rod-shaped and extend from portions of the outer circumferential surface.

The lugs 3 are provided on the outer circumferential surface of the shell 2. As shown in FIG. 1, on the outer circumferential surface of the shell 2, the lug 3A is provided at a top right position, the lug 3B is provided at an upper right position, the lug 3C is provided at a lower right position, the lug 3D is provided at a bottom right position, the lug 3E is provided at a bottom left position, the lug 3F is provided at a lower left position, the lug 3G is provided at an upper left position, and the lug 3H is provided at a top left position. The lugs 3A to 3H are provided at intervals of approximately 45 degrees in the circumferential direction of the shell 2. A tuning pin (not shown) for adjusting the tension of the drumhead is coupled to each of the lugs 3A to 3H.

The weights 5 are members formed by processing a material with a relatively large specific gravity into blocks. For example, the weights 5 have a columnar shape that is sufficiently short compared to the inner diameter of the shell 2. Note that the specific shape of the weights 5 is not limited to this example. For example, the weights 5 may have the shape of a rectangular parallelepiped. The material of the weights 5 is iron, for example, but may be stainless steel, brass, zinc, etc.

The weights 5 are provided so as to be dispersed at intervals in the circumferential direction of the shell 2, and are fixed to the inner circumferential surface of the shell 2. As shown in FIG. 1, on the inner circumferential surface of the shell 2, the weight 5A is provided between the lugs 3H and 3A that are adjacent to each other in the circumferential direction of the shell 2, the weight 5B is provided between the lugs 3B and 3C that are adjacent to each other, the weight 5C is provided between the lugs 3D and 3E that are adjacent to each other, and the weight 5D is provided between the lugs 3F and 3G that are adjacent to each other. In this way, the weights 5A to 5D are provided at positions where the weights 5A to 5D have four-fold rotational symmetry in the circumferential direction of the shell 2 (in other words, at intervals of 90 degrees in the circumferential direction of the shell 2). Also, the weights 5 are each provided at the center point of a section between two lugs 3 that are adjacent to each other, in the circumferential direction of the shell 2.

The shell 2 vibrates in response to the drumhead stretched over the open end vibrating. The vibration of the shell 2 is represented as a superposition of a plurality of vibration modes. The weights 5 are located as described above, and the positions are determined in view of the vibration modes of the shell 2. That is, the weights 5 are provided at or near positions where the vibration level of the shell in a certain vibration mode is higher than other positions of the shell when the weights 5 are not provided.

The weights 5 are fixed to the inner circumferential surface of the shell 2 as described above. For example, the shell 2 is provided with through holes (not shown) into which bolts (not shown) are inserted. The bolts are inserted into the through holes from the outside to the inside of the shell 2. The weights 5 are each provided with a groove (not shown). A portion of a bolt inserted into a through hole, which protrudes inward of the shell 2, engages with such a groove. Each bolt is fastened tight with the shell 2 sandwiched between its head and a weight 5. Thus, the weights 5 are fixed to the shell 2. Note that the method for fixing the weights 5 to the shell 2 is not limited to this example. Also, when the weights 5 have a columnar shape, one end side of each weight 5 in the axial direction is fixed to the inner circumferential surface of the shell 2.

The weights 5 have substantially the same mass. For example, the mass of each weight 5 is approximately 1 kg. The total mass of the weights 5 fixed to the shell 2 is preferably within the range of 25% to 200% of the mass of a shell to which the weights 5 are not fixed (i.e. a typical shell). The mass of a typical shell of a bass drum is approximately 4 kg. Therefore, the total mass of the weights 5 fixed to the shell 2 is preferably within the range of approximately 1 kg, which is 25% of the mass of a typical shell, to approximately 8 kg, which is 200% of the mass of a typical shell. When the mass of each weight 5 is approximately 1 kg, the total mass of the weights 5 is approximately 4 kg, which is within the range of approximately 1 kg to approximately 8 kg. This concludes the configuration of the drum 1.

In the drum 1, the weights 5 are fixed to the shell 2. Therefore, in the drum 1, the shell 2 and the weights 5 are integrated into one piece, and the overall mass of the shell 2 is greater than that of a typical shell. When an operation to play (hit) the drum 1 is performed, the shell 2 vibrates in response to the drumhead vibrating. When the shell 2 in a stationary state starts vibrating, the shell 2 has a tendency to remain in the stationary state due to inertia. The tendency to remain in a stationary state increases as the mass of the shell 2 increases. Therefore, in the drum 1 having the shell 2 with an increased mass, the vibration of the shell 2 is suppressed in a frequency range around the fundamental tone of the drum sound. As a result of the vibration of the shell 2 being suppressed, energy applied to the drum 1 through an operation performed to play the drum 1 is consumed less by the vibration of the shell 2 while it is consumed more by the vibration of the drumhead. Therefore, in the drum 1, the drumhead vibrates more in a frequency range around the fundamental tone, and produces the fundamental tone with increased sustain. The fundamental tone with increased sustain leads to a clearer low tone.

Also, in the shell 2 that vibrates in response to an operation performed to play the drum 1, a portion that instantaneously moves inward of the shell 2 and a portion that instantaneously moves outward of the shell 2 alternatingly appear in the circumferential direction of the shell 2. The number of such repetitive appearances in the circumferential direction of the shell 2 increases as the order of the vibration mode of the shell increases. In the drum 1, a plurality of weights 5 are fixed at intervals in the circumferential direction of the shell 2. By providing intervals in the circumferential direction of the shell 2, it is possible to fix the weights 5 respectively to portions that move inward or outward of the shell 2 and that alternatively appear in the circumferential direction of the shell 2 (i.e. portions corresponding to the antinodes of the vibration of the shell 2 in the vibration mode of the shell 2). At such portions corresponding to the antinodes of the vibration of the shell 2, once vibration starts, the vibration is sustained due to inertia. The extent to which the vibration is sustained increases as the mass of the portions increases. Therefore, in the drum 1 in which a plurality of weights 5 are fixed to the shell 2 so as to be dispersed in the circumferential direction of the shell 2, the vibration of the shell 2 is sustained in certain frequency bands of the drum sound (specifically, the frequency bands of high order-side harmonics of the fundamental tone). As a result of the vibration of the shell 2 being sustained, energy applied to the drum through an operation performed to play the drum is consumed more by the vibration of the shell 2 while it is consumed less by the vibration of the drumhead. For this reason, with the drum 1, the vibration of the drumhead decreases in certain frequency bands of the drum sound (specifically, the frequency bands of high order-side harmonics of the fundamental tone), and the sustain of the drum sound in certain frequency bands (specifically, the sustain of high order-side harmonics of the fundamental tone) decreases.

In the drum 1, the weights 5 are fixed at certain positions in view of the vibration mode of the shell 2, i.e. positions where the weights 5 have four-fold rotational symmetry in the circumferential direction of the shell 2. Thus, with the drum 1, it is possible to efficiently sustain the vibration of the shell 2 in the frequency bands of high order-side harmonics of the fundamental tone. Therefore, with the drum 1, it is possible to efficiently reduce the sustain of high order-side harmonics of the fundamental tone.

Also, in the drum 1, the total mass of the weights 5 and the mass of each weight 5 are determined so that the total mass of the weights 5 is within the range of 25% to 200% of the mass of a typical shell. By employing such a mass as the mass of the weights 5 that are to be dispersed on the shell 2, it is possible to further reduce the sustain of high order-side harmonics of the fundamental tone.

As described above, the drum 1 according to the present embodiment produces sound that contains the fundamental tone with increased sustain and the high order-side harmonics of the fundamental tone with reduced sustain. That is, with the drum 1, it is possible to obtain drum sound with higher quality in which a low tone (i.e. the fundamental tone) is clearer and more distinctive than that in the sound of a typical drum.

Also, in the drum 1, the weights 5 are fixed to the inner circumferential surface of the shell 2, and the weights 5 are unobtrusive when the shell 2 is seen from the outside of the shell 2. Therefore, the external appearance of the drum 1 remains almost the same as that of a typical drum.

Figure 2:
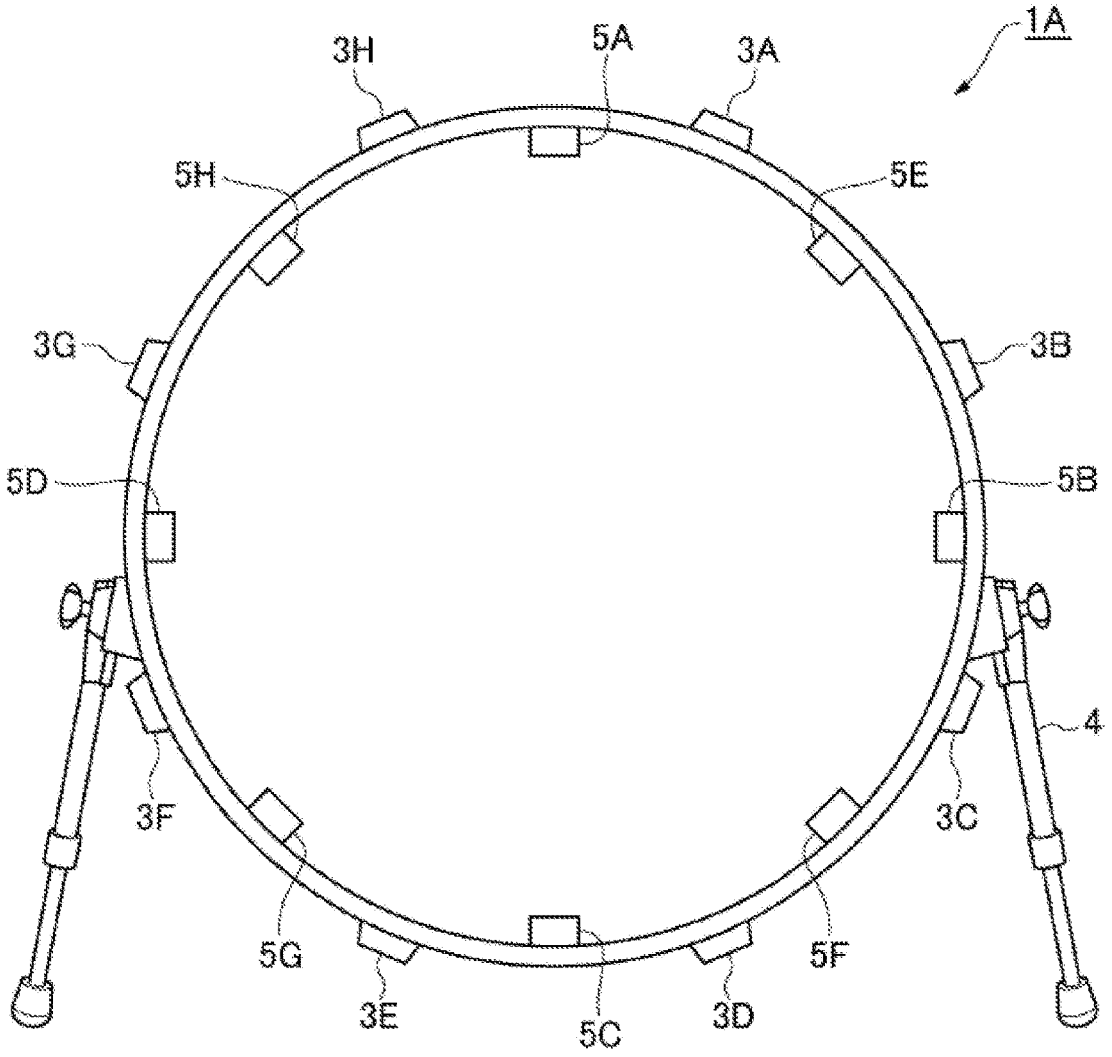
FIG. 2 is a front view showing a configuration of a drum 1A that is a second embodiment of the present invention.

Next, the following describes a drum that is a second embodiment of the present invention. FIG. 2 is a front view showing a configuration of a drum 1A that is the second embodiment of the present invention. The drum 1A is different from the drum 1 according to the first embodiment in that the drum 1A has weights 5E to 5H in addition to the weights 5A to 5D. The weights 5E to 5H are the same as the weights 5A to 5D. Also in the present embodiment, when the weights 5A to 5H are not distinguished from each other, they are denoted as weights 5.

In the drum 1A, eight weights 5 are fixed to the inner circumferential surface of the shell 2 so as to be dispersed in the circumferential direction of the shell 2. The weights 5A to 5D are provided at the same positions as those of the drum 1. Whereas, as shown in FIG. 2, on the inner circumferential surface of the shell 2, the weight 5E is provided between the lugs 3A and 3B that are adjacent to each other in the circumferential direction of the shell 2, the weight 5F is provided between the lugs 3C and 3D that are adjacent to each other, the weight 5G is provided between the lugs 3E and 3F that are adjacent to each other, and the weight 5H is provided between the lugs 3G and 3H that are adjacent to each other. In this way, the weights 5A to 5H according to the present embodiment are provided so as to have eight-fold rotational symmetry in the circumferential direction of the shell 2 (in other words, they are provided at intervals of 45 degrees in the circumferential direction of the shell 2).

Thus, in the drum 1A, the number of weights 5 that are fixed to the shell 2 is increased compared to those in the drum 1, and the weights 5 are dispersed in the circumferential direction of the shell 2 at smaller intervals.

The mass of each weight 5 according to the present embodiment is approximately 0.5 kg, for example. The number of weights 5 in the drum 1A is eight, and therefore the total mass of the weights 5 in the drum 1A is approximately 4 kg in this case. In this way, the total mass of the weights 5 that are fixed to the shell 2 in the drum 1A is also within the range of 25% to 200% of the total mass of the shell to which the weights 5 are not fixed.

In the drum 1A according to the present embodiment, as in the drum 1 according to the first embodiment, a plurality of weights 5 are fixed to the shell 2 so as to be dispersed in the circumferential direction of the shell 2. Therefore, the present embodiment also achieves effects similar to those of the first embodiment.

Also, in the drum 1A, the distribution of the weights 5 in the circumferential direction of the shell 2 is more uniform than that in the drum 1. As a result, in the drum 1A, the vibration of the shell 2 is presumably sustained in a wider range than in the drum 1, from harmonics that are close to the fundamental tone to high order-side harmonics that are away from the fundamental tone. Therefore, with the drum 1A, it is possible to efficiently reduce the sustain of high order-side harmonics of the fundamental tone in a wide frequency range. Thus, with the drum 1A, it is possible to obtain drum sound with higher quality than that of the drum 1.

Also, in the drum 1A, the number of lugs 3 and the number of the weights 5 are the same, and each weight 5 is provided at the center point between two lugs 3 that are adjacent to each other in the circumferential direction of the shell 2. That is, in the drum 1A, the lugs 3 and the weights 5 are alternatingly provided in the circumferential direction of the shell 2. As a result, the members with certain masses (the lugs 3 and the weights 5) are more uniformly provided on the shell 2 of the drum 1A than on that of the drum 1. Therefore, in the drum 1A, the influence of the shell 2 when vibrating and deforming is presumably more uniform in the circumferential direction of the shell 2 than that in the drum 1.

Although the first and second embodiments of the present invention are described above, the present invention may be variously modified. For example, the following modifications may be made.

(1) In the drums 1 and 1A according to the first and second embodiments, the weights 5 are fixed at positions where the weights 5 have rotational symmetry in the circumferential direction of the shell 2. However, the weights 5 may not be fixed at positions where the weights 5 have rotational symmetry in the circumferential direction of the shell 2. This is because it can be expected that the vibration of the shell 2 will be sustained in a certain frequency band, provided that a plurality of weights 5 are fixed to the shell 2 at intervals in the circumferential direction of the shell 2.

(2) Four weights 5 are fixed to the shell 2 of the drum 1 according to the first embodiment, and eight weights are fixed to the shell 2 of the drum 1A according to the second embodiment. However, the number of weights 5 is not limited to these examples. Also, the number of weights 5 is not limited to being plural, and may be one. This is because sound that contains the fundamental tone with increased sustain can be obtained, provided that at least one weight 5 is fixed to the shell 2. However, if only one weight 5 is fixed to the shell 2, it cannot be expected that the vibration of the shell 2 will be sustained in a certain frequency band. Therefore, a mode in which a plurality of weights 5 are fixed to the shell 2 is preferable compared to a mode in which one weight is fixed to the shell 2. Also, considering the vibration mode of the shell 2, it is preferable that the number of weights 5 is not an odd number, but an even number (more specifically, an even number that is greater than or equal to 2).

(3) In the drums 1 and 1A according to the first and second embodiments, the weights 5 are fixed to the inner circumferential surface of the shell 2. However, the weights 5 may be fixed to the outer circumferential surface of the shell 2.

(4) The drums 1 and 1A according to the first and second embodiments are bass drums. However, the present invention is not limited to being applied to a bass drum. The present invention is applicable to various kinds of drums such as a floor tom, a tom-tom, or a snare drum. That is, with these various kinds of drums, it is possible to obtain effects similar to those of the first and second embodiments by fixing a plurality of weights to the shell so as to be dispersed in the circumferential direction of the shell. Also in these various kinds of drums, it is preferable that the total mass of the weights is within the range of 25% to 200% of the mass of the shell of the drum. For example, in the case of application to a floor tom, the total mass of the weights is determined with reference to the mass of the shell of the floor tom. By determining the total mass of the weights in such a way, it is possible to obtain effects similar to those of the first and second embodiments even when the present invention is applied to a drum other than a bass drum.

Figure 3:
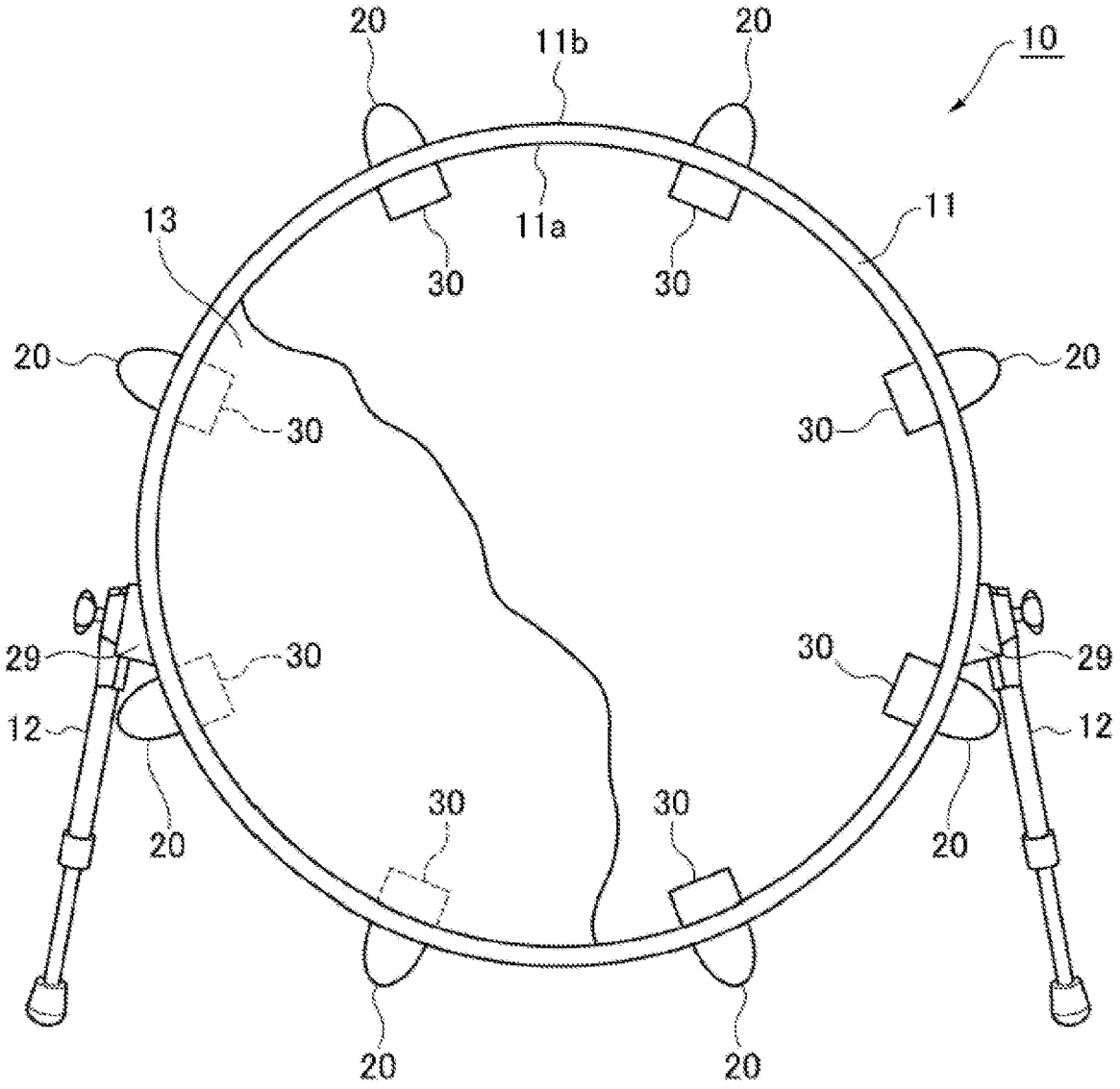
FIG. 3 is a front view of a drum.

Next, the following describes a drum that is a third embodiment of the present invention. FIG. 3 is a front view of a drum according to the third embodiment of the present invention. This drum 10 is also configured as a bass drum, for example. The drum 10 includes a shell 11 that has a cylindrical shape with two open ends. A drumhead 13 is stretched over an open end of the shell 11. The shell 11 is supported by rod-shaped legs 12, with two leg attachment portions 29, which are attached to the outer circumferential surface, being interposed between the shell 11 and the legs 12. As a result, the shell 11 is used in an orientation in which a plane that includes the open end is orthogonal to the ground (in other words, an orientation in which the normal of the drumhead 13 is parallel to the ground).

A plurality of lugs 20 are provided on an outer circumferential surface 11*b* of the shell 11. The lugs 20 are provided in the circumferential direction of the shell 11 at equal intervals of approximately 45 degrees, and eight lugs 20 are provided in total. A tuning pin (not shown) for adjusting the tension of the drumhead 13 is coupled to each of the lugs 20. The lugs 20 are examples of functional parts that achieve a drum function (in this example, the function of adjusting the tension of the drumhead 13) when attached to the shell 11. A total of eight weights 30 are provided on an inner circumferential surface 11*a* of the shell 11 in correspondence with the lugs 20. Each weight 30 is provided on the opposite side of the lug 20 corresponding thereto with respect to the wall portion of the shell 11. Therefore, the weights 30 are dispersed at intervals in the circumferential direction of the shell 11. The material of the weights 30 is iron, for example, but may be stainless steel, brass, zinc, etc.

Figure 4A:
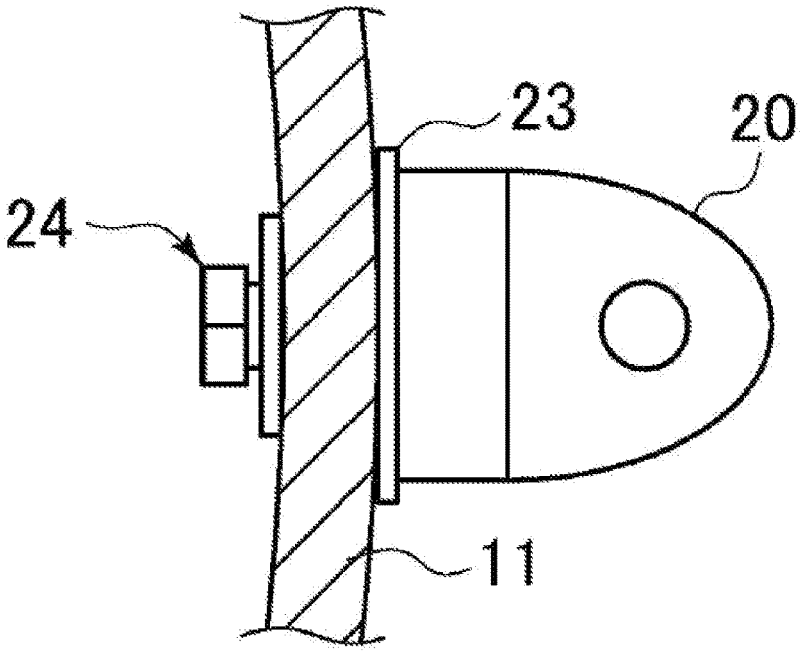
FIG. 4A is a cross-sectional view of a portion around a lug according to conventional art.
Figure 4B:
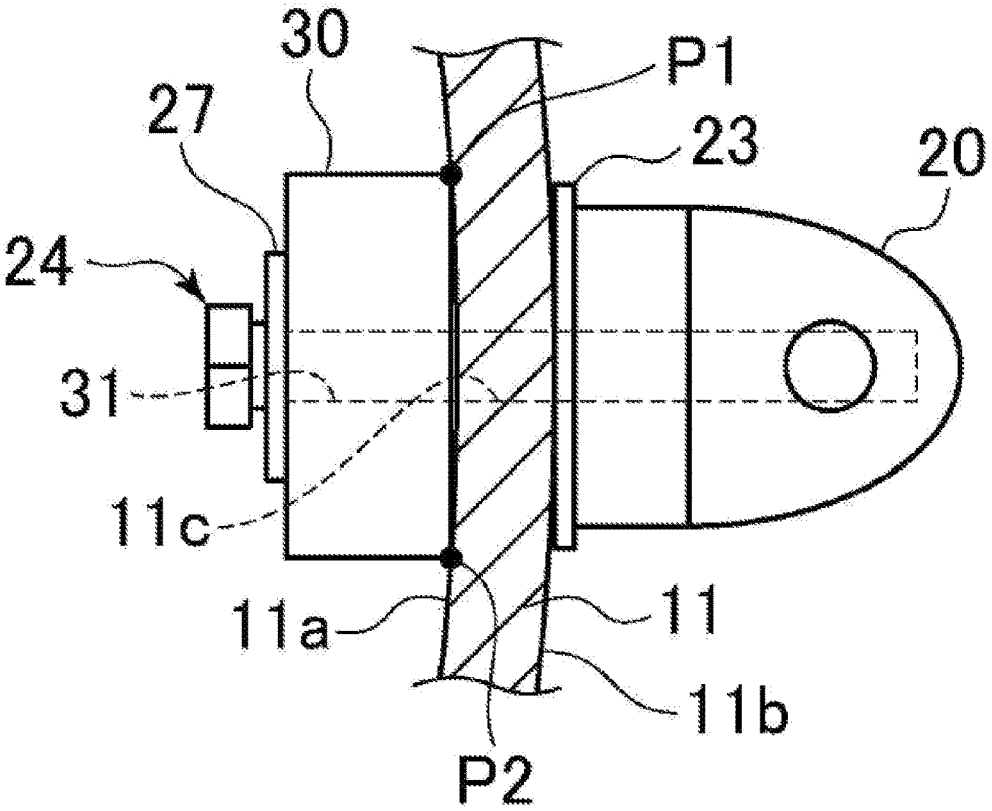
Prior Art Fig.4B
FIG. 4B is a cross-sectional view of a portion around a lug according to the embodiment.

Next, the following describes an attachment structure for the lugs 20 and the weights 30. Since the eight sets of a lug 20 and a weight 30 have the same configuration, one set will be described as a representative with reference to FIGS. 4A to 4D. For the purpose of comparison, an attachment structure for a conventional lug 20 that is not provided with a weight 30 is shown in FIG. 4A. FIGS. 4A and 4B are cross-sectional views of a portion around a lug 20 according to conventional art and the present embodiment, respectively. These figures each show a cross section that is orthogonal to the direction in which the central axis of the shell 11 extends.

First, in the conventional configuration (FIG. 4A), the lug 20 is attached to the shell 11 from the outer circumferential surface-side, with a plate 23 being interposed therebetween, and the lug 20 is fastened to the shell 11 using a bolt 24 that is screwed into the lug 20 from the inner circumferential surface-side.

Figure 4C:
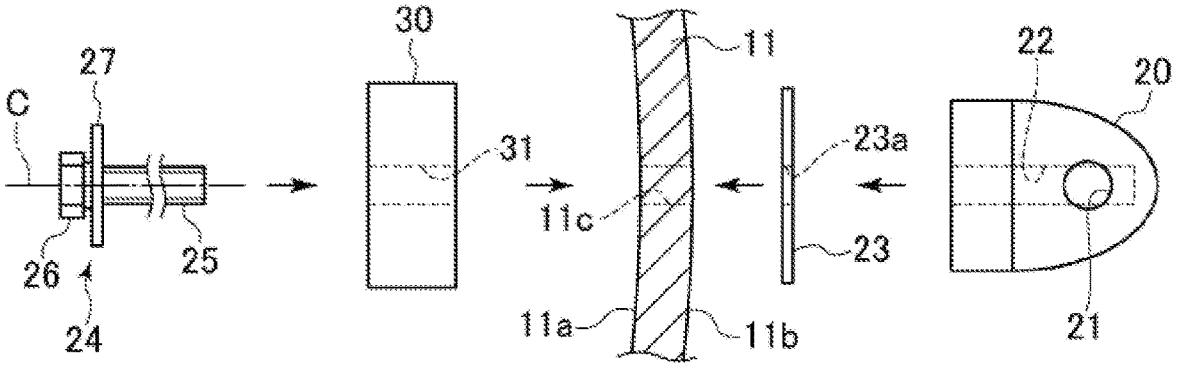
FIG. 4C is an exploded view of a lug and a weight according to the embodiment.
Figure 4D:
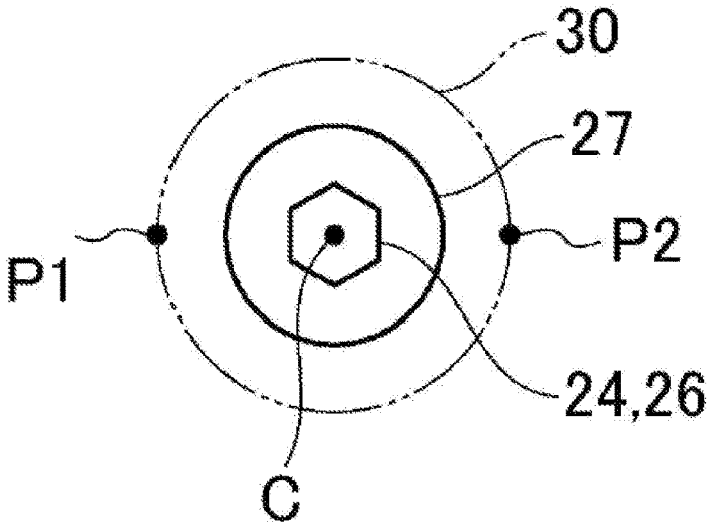
FIG. 4D is a diagram showing a bolt and a weight seen from the inner circumference side of a shell according to the embodiment.

FIG. 4C is an exploded view of a lug 20 and a weight 30 according to the present embodiment. FIG. 4D shows a bolt 24 and a weight 30 seen from the inner circumferential surface-side of the shell 11. The present embodiment is different from conventional art in that the drum 10 has the weights 30, but is the same as existing conventional drums in other configurations. The configurations of the lug 20, the plate 23, and the bolt 24 are the same as those of conventional art. The bolt 24 includes a head 26, a flange 27, and a shaft 25 (FIG. 4C). Note that, as a result of the weight 30 being provided, the length of the shaft 25 of the bolt 24 and the presence or absence of the flange 27 may be different from those of conventional art.

The lug 20 has a screw hole 21 into which a tuning pin is screwed, and also has a screw hole 22 into which a bolt 24 is screwed (FIG. 4C). In a state where the lug 20 is attached to the shell 11, the screw hole 21 is substantially parallel to the direction in which the central axis of the shell 11 extends, and the screw hole 22 is substantially parallel to the radial direction of the shell 11 (the direction in which an axis C of the shaft 25 of the bolt 24 extends). The weight 30 has a cylindrical shape with a through hole 31 for fastening. The plate 23 and the shell 11 are respectively provided with through holes 23*a* and 11*c* for fastening.

When attaching the lug 20 and the weight 30, a worker places the plate 23 and the lug 20 on the outer circumferential surface 11*b* side of the shell 11, and places the weight 30 on the inner circumferential surface 11*a* side of the shell 11. Thereafter, the worker passes the shaft 25 of the bolt 24 through the through hole 31 of the weight 30, the through hole 11*c* of the shell 11, and the through hole 23*a* of the plate 23, from the inner circumferential surface 11*a* side of the shell 11, and screws the shaft 25 into the screw hole 22 of the lug 20. Thus, the weight 30 is fixed to the shell 11 in the state of being fastened together with the lug 20.

The present embodiment is different from conventional art only in that the weight 30 is interposed between the flange 27 of the bolt 24 and the inner circumferential surface 11*a* of the shell 11 when the lug 20 is to be fastened to the shell 11 using the bolt 24. This work process is the process of screwing one bolt 24, which is not different from that in conventional art.

The weight 30 is cylindrical. Therefore, in a state where the weight 30 is fixed to the shell 11 (FIGS. 4B and 4D), the bolt 24 has a circular shape when seen in the axial direction of the shaft 25 (which is also the axial direction of the through hole 31), and has rotational symmetry with respect to the axis C of the shaft 25 (which is also the axis of the through hole 31). Therefore, the worker does not need to be careful about the orientation of the weight 30 in the circumferential direction. In addition, the external shape of the weight 30 and the inner diameter of the through hole 31 of the weight 30 are uniform. Therefore, there is no need to be careful about which of the two end faces should face the inner circumferential surface 11*a* of the shell 11. The above factors make work easier.

Also, in the state of being fixed to the shell 11 (FIGS. 4B and 4D), the weight 30 is in contact with the inner circumferential surface 11*a* of the shell 11 at two points (contacting points P1 and P2) in the circumferential direction of the shell 11, which are opposite to each other with respect to the axis C of the shaft 25 of the bolt 24 in the circumferential direction of the shell 11. Thus, the weight 30 is stably fixed to the shell 11. Therefore, when the drum 10 is used (when the shell 11 vibrates as a result of being hit to be played), the weight 30 is not displaced independent of the shell 11, but is displaced together with the shell 11.

In the drum 10, the shell 11 and the weight 30 are integrated into one piece, and the overall mass of the shell 11 is greater than that of a conventional (existing) shell. When an operation to play (hit) the drum 10 is performed, the shell 11 vibrates in response to the drumhead 13 vibrating. When the shell 11 in a stationary state starts vibrating, the shell 11 has a tendency to remain in the stationary state due to inertia. The tendency to remain in a stationary state increases as the mass of the shell 11 increases. Therefore, in the drum 10 having the shell 11 with an increased mass, the vibration of the shell 11 is suppressed in a frequency range around the fundamental tone of the drum sound. As a result of the vibration of the shell 11 being suppressed, energy applied to the drum 10 through an operation performed to play the drum 10 is consumed less by the vibration of the shell 11 while it is consumed more by the vibration of the drumhead 13. For this reason, the vibration of the drumhead 13 decreases in certain frequency bands of the drum sound (specifically, the frequency bands of high order-side harmonics of the fundamental tone), and the sustain of the drum sound in certain frequency bands (specifically, the sustain of high order-side harmonics of the fundamental tone) decreases. As a result, the drumhead 13 vibrates more in a frequency range around the fundamental tone, and produces the fundamental tone with increased sustain. The fundamental tone with increased sustain leads to a clearer low tone.

It is preferable that the total mass of the eight weights 30 that are fixed to the shell 11 is within the range of 25% to 200% of the mass of the shell 11 to which no weights 30 are fixed (i.e. a typical shell). The mass of a typical shell of a bass drum is approximately 4 kg. Therefore, it is preferable that the total mass of the plurality of weights 30 fixed to the shell 11 is greater than approximately 1 kg, which is 25% of the mass of a typical shell, and is smaller than approximately 8 kg, which is 200% of the mass of a typical shell. By setting such a total mass to the total mass of the weights 30 that are to be dispersed on the shell 11, it is possible to further reduce the sustain of high order-side harmonics of the fundamental tone, which leads to a clearer low tone.

With the drum 10 according to the present embodiment, the weights 30 are fixed relative to the shell 11 in a state where the lugs 20 are fixed to the shell 11 using the bolts 24. Therefore, it is possible to increase the sustain of the fundamental tone. The weights 30 can be attached through an existing process of manufacturing a drum, or by a user who has purchased the drum. Therefore, it is possible to improve the sound quality of existing drums. Especially, the weights 30 are fixed to the shell 11 through the task of attaching the lugs 20 to the shell 11 using the bolts 24, and therefore there is no need to make the work process complex in order to attach the weights 30. In addition, the weights 30 are fixed to the shell 11 using the bolts 24, in the state of being fastened together with the lugs 20. Therefore, there is no need to provide a dedicated attachment mechanism, and application to existing drums is easy.

Also, a fastening member corresponding to one lug 20 is one bolt 24, and each weight 30 in a fixed state has a circular shape when seen in the axial direction of the bolt 24, and has rotational symmetry with respect to the axis C of the bolt 24. As a result, there is no need to pay attention to the orientation of the weights 30 when fixing the weights 30, which makes work easier.

Also, each weight 30 is in contact with the shell 11 at two contacting points P1 and P2 in the circumferential direction of the shell 11, which are opposite to each other with respect to the axis C of the bolt 24 in the circumferential direction of the shell 11. Therefore, the weight 30 is stably fixed to the shell 11, which enhances the effect of improving sound quality. Also, the total mass of the weights 30 fixed to the shell 11 is greater than 25% of the mass of the shell 11 to which no weights 30 are fixed, and therefore the fundamental tone has increased sustain.

Note that the shape of the weights and the mode in which the weights are provided may be variously modified. Such modifications will be described with reference to FIGS. 5A to 5C, 6A to 6C, 7A, 7B, 8A, and 8B.

Figure 5A:
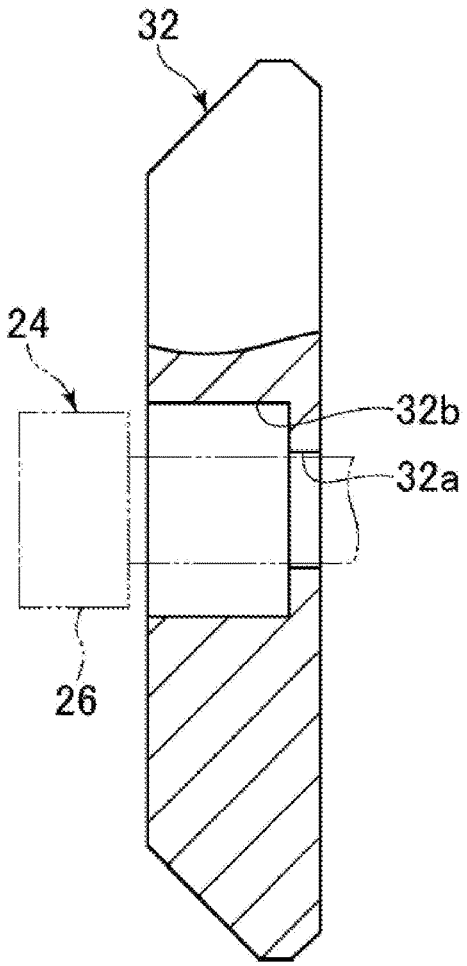
FIG. 5A is a cross-sectional view of a weight according to a modification.
Figure 5B:
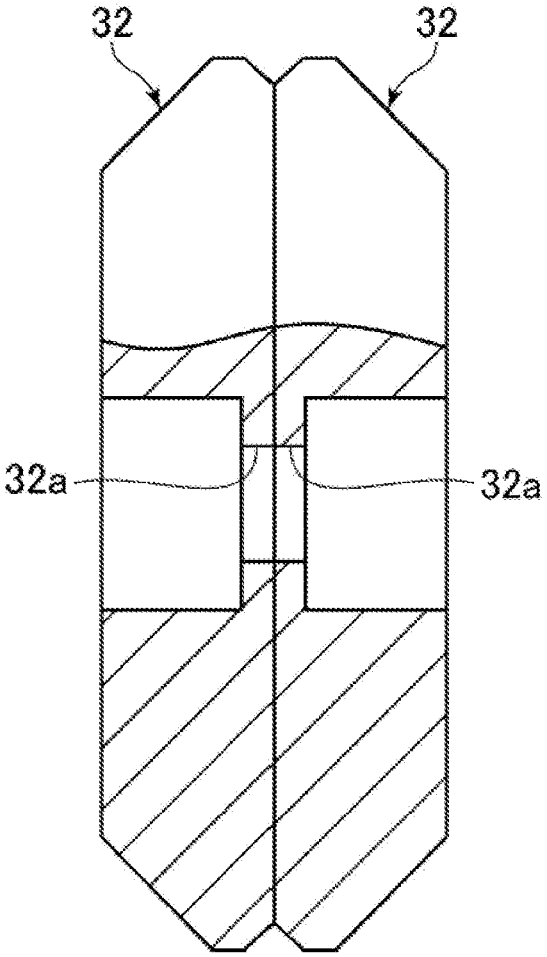
FIG. 5B is a cross-sectional view of a weight according to a modification.
Figure 5C:
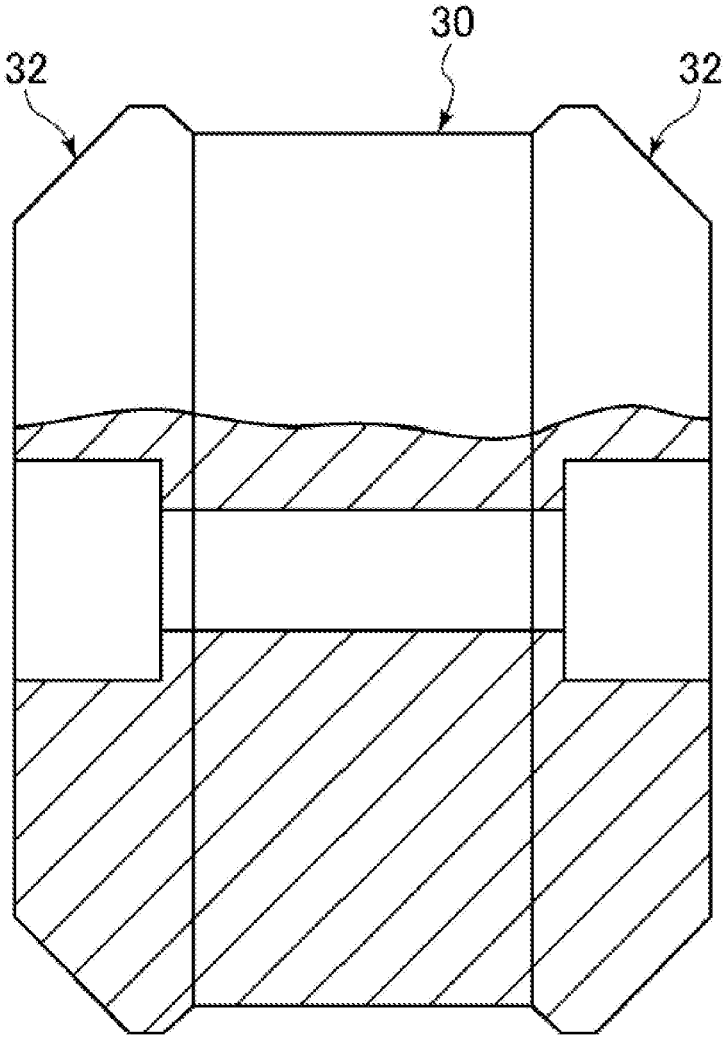
FIG. 5C is a cross-sectional view of a weight according to a modification.

FIGS. 5A, 5B, and 5C are cross-sectional views of weights according to modifications. A weight 32 shown in FIG. 5A has an inclined surface on one end surface side. The weight 32 also has a through hole 32*a* for fastening and a release hole 32*b* that is greater than the through hole 32*a*. As with the weights 30, the weight 32 has a circular shape when seen in the axial direction of the bolt 24, and has rotational symmetry with respect to the axis C of the bolt 24. Note that the bolt 24 does not need to have the flange 27, and if a bolt 24 without a flange 27 is used, the head 26 fills the release hole 32*b*.

Note that a plurality of weights may correspond to one lug 20. For example, as shown in FIG. 5B, two weights 32 are combined as a set of weights, and the set of weights may be fixed to the shell 11 through an operation performed to screw one bolt 24. If end surfaces in which the through holes 32*a* are provided are in contact with each other, there is no need to be careful about which end surface of the set of weights should face the shell 11.

Also, the weights do not necessarily have the same shape. For example, the weight 30 shown in FIG. 4C and so on may be combined with weights 32 such that the weights 32 sandwich the weight 30 (FIG. 5C). Also in this case, there is no need to be careful about which end surface of the set of combined weights should face the shell 11. Note that three or more weights may be employed. One or more weights freely selected from among a plurality of weights may be fixed to either one or both of the lug 20 and the bolt 24.

Figure 6A:
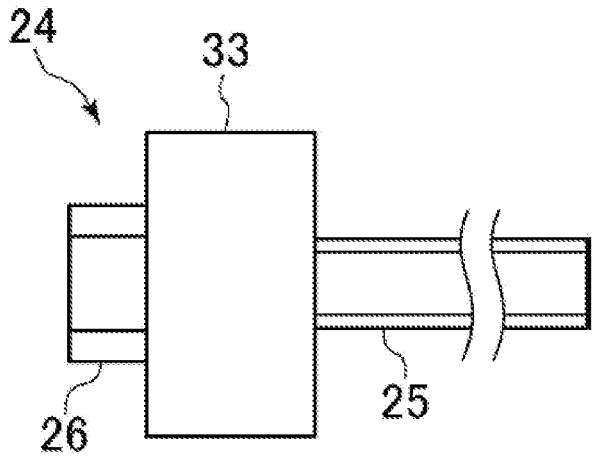
FIG. 6A is a side view of a bolt according to a modification.

FIG. 6A is a side view of a bolt 24 according to a modification. A weight 33 may be formed integrally with a portion of the bolt 24 such as a portion between the head 26 and the shaft 25 as shown in FIG. 6A, instead of being separately provided. As a result, it is possible to fix the weight 33 to the shell 11 by carrying out the task of fastening the lug 20 using the bolt 24, which is the same as a conventional task.

Figure 6B:
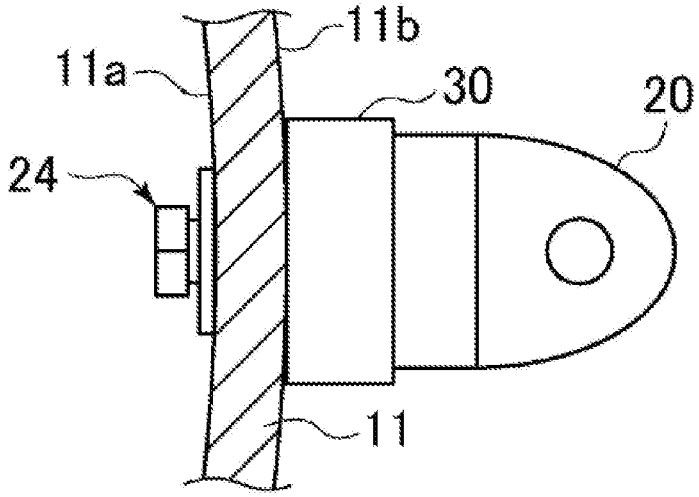
FIG. 6B is a cross-sectional view of a portion around a lug according to a modification.
Figure 6C:
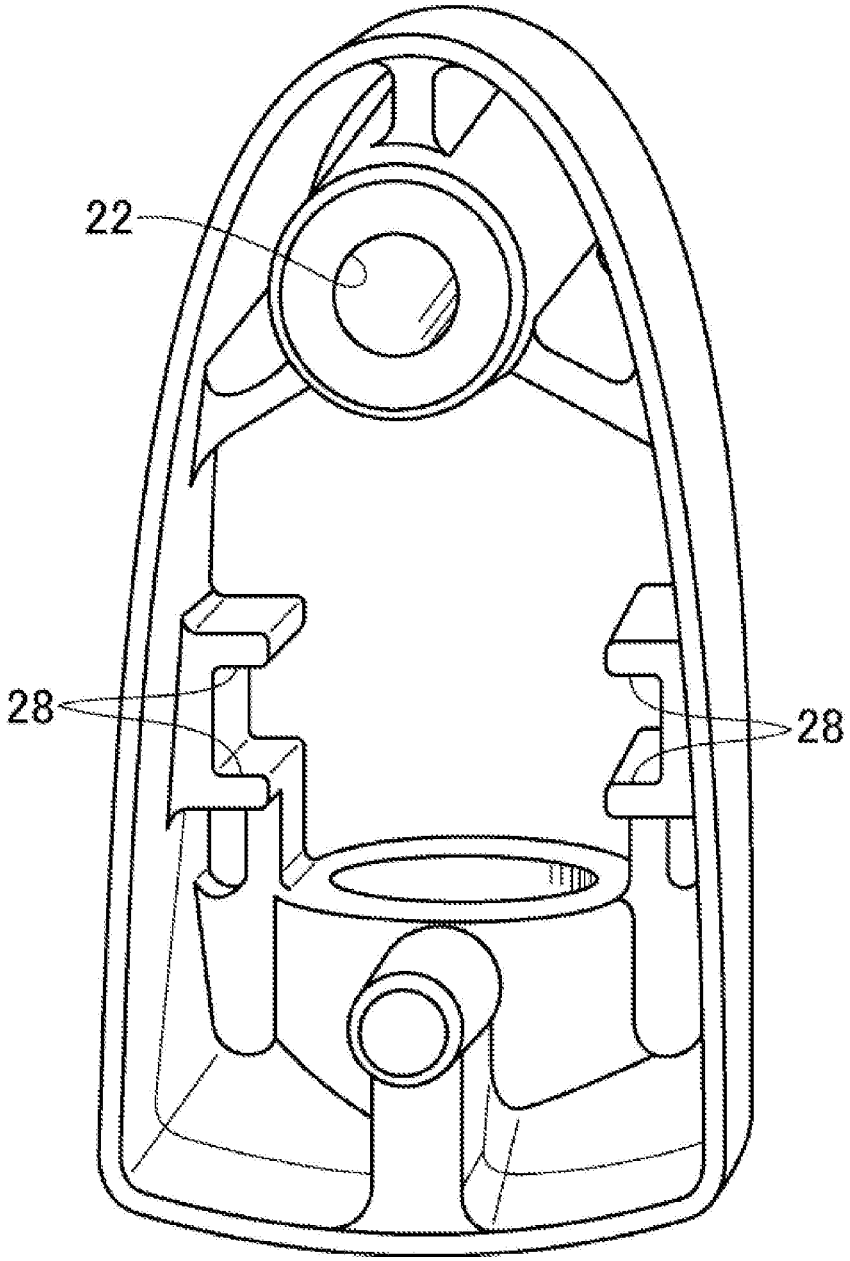
FIG. 6C is a perspective view of a lug according to a modification.

FIG. 6B is a cross sectional view of a portion around a lug 20. The weight 30 may be placed so as to face the outer circumferential surface 11*b* of the shell 11, and thus the weight 30 and the lug 20 may be fixed together to the shell 11 using the bolt 24 such that the weight 30 is interposed between the lug 20 and the outer circumferential surface 11*b*. The plate 23 may be provided, but is not essential. FIG.

6C is a cross sectional view of a lug 20. A weight may be built into the lug 20. In a state where a weight is held by holding portions 28 in the lug 20, a worker fastens the lug 20 to the shell 11 using the bolt 24, in the same mode as a conventional mode. Note that a plurality of types of weights that can be attached to the lug 20 may be prepared, and a weight freely selected may be built into the lug 20. Whether or not to attach a weight to the lug 20 is also selectable.

In addition, the head of the bolt 24 may be formed of a magnetic material, the weight may be formed using a magnet, and thus the weight may be configured so as to fixable to the bolt 24 using a magnetic force. If this is the case, the area of the head of the bolt 24 with which the weight is in contact may be set large so that the weight is stable in a fixed state.

From the viewpoint of stabilizing the weight in the state of being fixed to the shell 11, the weight may be configured to be in contact with the shell 11 at two points in the circumferential direction of the shell 11, which are opposite to each other with respect to the axis C of the bolt 24. Therefore, linear contact or surface contact may be employed as contact with the shell 11. Also, the shape of the weights 30 is not limited to a cylindrical shape, and may be a rectangular parallelepiped shape or the like.

Figure 7A:
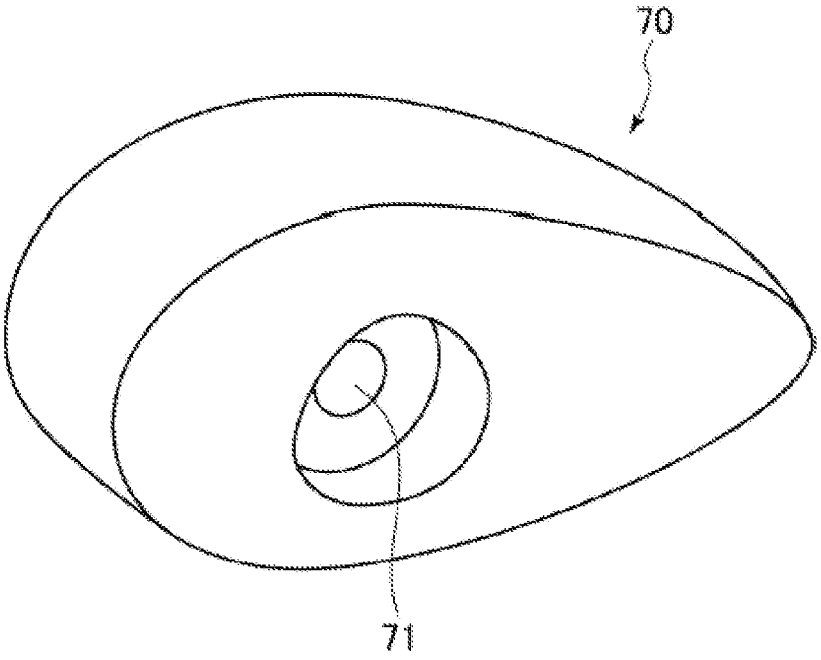
FIG. 7A is a perspective view of a weight according to another modification.
Figure 7B:
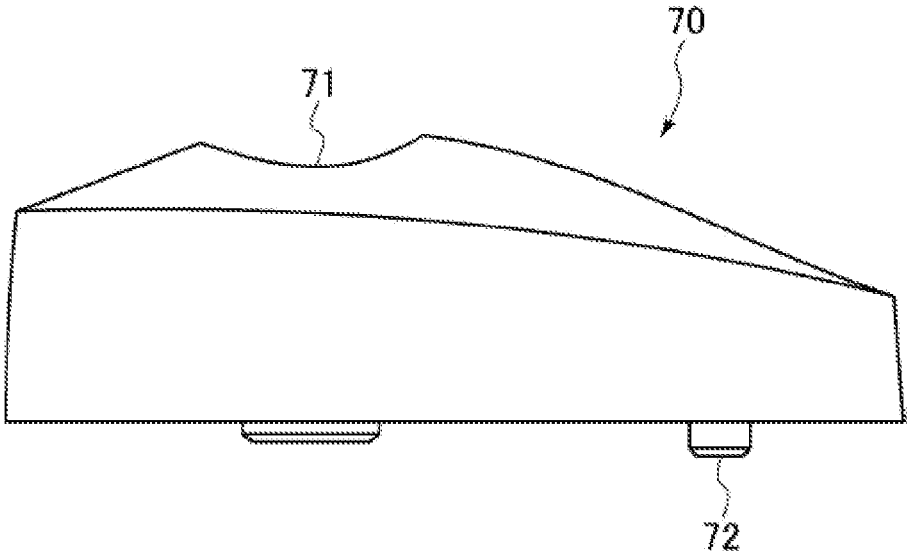
FIG. 7B is a side view of the weight according to the other modification.
Figure 8A:
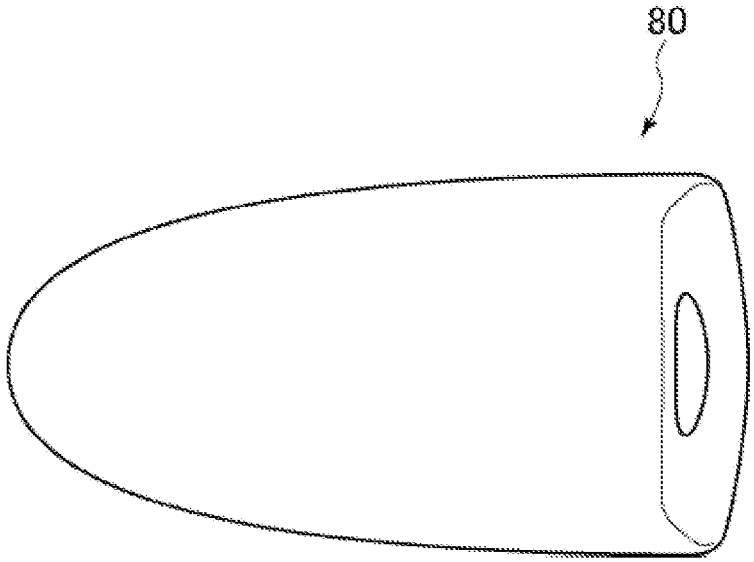
FIG. 8A is a plan view of a lug according to the other modification.
Figure 8B:
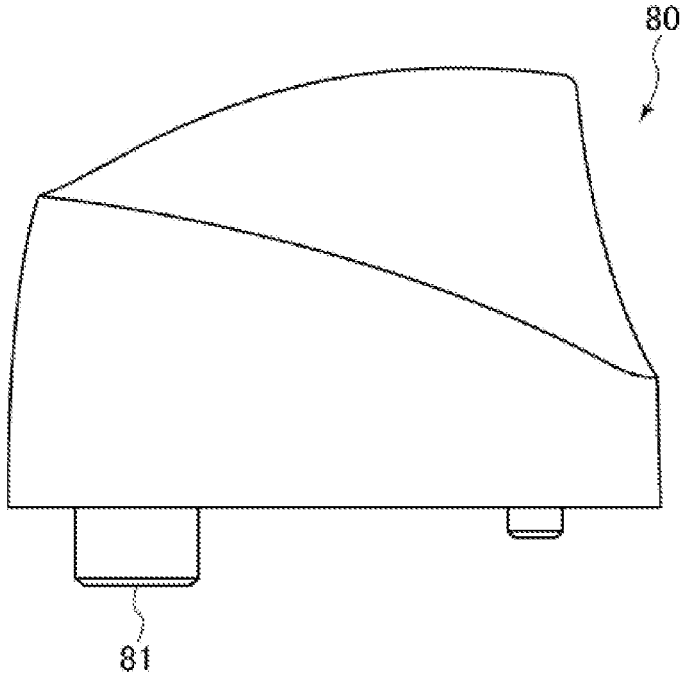
FIG. 8B is a side view of the lug according to the other modification.

FIG. 7A is a perspective view of a weight according to another modification. FIG. 7B is a side view of the weight according to the other modification. FIG. 8A is a plan view of a lug according to the other modification. FIG. 8B is a side view of the lug according to the other modification. A weight 70 shown in FIGS. 7 A and 7B is paired with a lug 80 shown in FIGS. 8A and 8B.

In the drum 10, the drumhead 13 may be formed of a transparent film. If this is the case, the audience can see the weights 70 provided on the inner circumferential surface 11*a* of the shell 11, through the drumhead 13.

The lug 80 that is located opposite to the weight 70 paired with the lug 80, with respect to the wall portion of the shell 11, often has a shape that is tapered in the direction in which the central axis of the shell 11 extends, when seen in the axial direction of the shaft 25 of the bolt 24. In such a case, if a weight 70 that has a shape similar to that of the lug 80 is used, it is possible to be visually pleasing to the audience, from the viewpoint of unity in design. Therefore, it is preferable to use a weight 70 that has a teardrop shape when seen in the axial direction of the shaft 25 of the bolt 24, whose lengthwise direction is substantially parallel to the axial direction of the shell 11, and that has a shape tapered in the axial direction of the shell 11.

The weight 70 has a through hole 71 that penetrates therethrough in the thickness direction. The lug 80 has a screw hole 81 for fastening. When the through hole 71 of the weight 70 and the screw hole 81 of the lug 80 are placed opposite to each other with respect to the wall portion of the shell 11, the shaft 25 of the bolt 24 is inserted into the through hole 71 of the weight 70 from the inner circumferential surface 11*a* side of the shell 11, and is screwed into the screw hole 81 of the lug 80. As a result, the weight 70 is fixed to the shell 11 in the state of being fastened together with the lug 80.

Also, the weight 70 has a protrusion 72 that protrudes toward the inner circumferential surface 11*a* of the shell 11, and when the weight 70 is fastened together with the lug 80, the protrusion 72 is in contact with the inner circumferential surface 11*a* of the shell 11. At this time, the force that fastens the weight 70 and the lug 80 together is concentrated at the protrusion 72, and a large frictional force is applied to the protrusion 72 from the inner circumferential surface 11*a*. As a result, the weight 70 is prevented from moving, especially from rotationally moving about the bolt 24. Thus, it is possible to prevent degradation in the appearance of the weight 70 due to the lengthwise direction of the weight 70 being displaced from the direction in which the central axis of the shell 11 extends.

Also, as described above, the head of the bolt 24 may be formed of a magnetic material, and the weight 30 may be formed using a magnet. However, the head of the bolt 24 may not be formed of a magnetic material, and only the weight 30 may be formed using a magnet. If this is the case, it is possible to directly or indirectly fix the weight 30 to the shell 11 using a magnetic force by using iron to form a portion of at least one of the shell 11, the lug 20, and the bolt 24. In this case, a fastening force of the bolt 24 may or may not be used to fix the weight 30 to the shell 11.

A percussion instrument to which the present invention is applicable is not limited to a bass drum, and may be another drum such as a snare drum, a floor tom, a tom-tom, and so on, and furthermore, may be a timpani with a substantially conical shell. Also, the functional parts that are to be attached to the shell may be any parts that achieve a certain function such as a drum function when attached to the shell, and are not limited to the lugs 20. For example, they may be the leg attachment portions 29 (FIG. 3) or pipe clamps. Also, fastening members that fasten the functional parts are not limited to bolts, and may be rivets or the like.

Note that, in a state where the functional parts are attached to the shell using the fastening members, the weights may be substantially fixed to the shell by being fixed to either one or both of the functional parts and the fastening members. Also, although each weight 30 in the above-described embodiments has only one through hole 31 for fastening, each weight may have a plurality of through holes for fastening. If this is the case, the shafts of a plurality of bolts that serve as the fastening members are inserted into the through holes and are screwed into a plurality of screw holes provided in the lugs.

Although the present invention is described in detail above based on preferred embodiments of the invention, the present invention is not limited to these specific embodiments, and various embodiments that fall within the scope of sprit of the present invention are included in the present invention.

The present invention claims priority to Japanese Patent Application No. 2016-214856 filed Nov. 2, 2016 and Japanese Patent Application No. 2017-039294 filed Mar. 2, 2017, and the entire contents of the Japanese Patent Applications are incorporated herein.

LIST OF REFERENCE NUMERALS

1, 1A, 10 . . . Drum, 2, 11 . . . Shell, 3A to 3H, 20, 80 . . . Lug (Functional parts), 4 . . . Leg, 5A to 5H, 30, 32, 33, 70 . . . Weight, 11*a* . . . Inner circumferential surface, 11*b* Outer circumferential surface, 24 . . . Bolt (Fastening member), 25 . . . Shaft

The invention claimed is:

1. A percussion instrument provided with a plurality of lugs, the percussion instrument comprising:

a substantially cylindrical barrel; and a plurality of weights fixed to the barrel at intervals in a circumferential direction of the barrel, with each weight fixed between and spaced apart from adjacent pair of lugs, among the plurality of lugs, which are spaced apart along the circumferential direction of the barrel.

2. The percussion instrument according to claim 1, wherein the plurality of weights are fixed to the barrel at positions where the plurality of weights have rotational symmetry in the circumferential direction of the barrel.

3. The percussion instrument according to claim 1, wherein the total mass of the plurality of weights fixed to the barrel is within the range of 25% to 200% of the mass of the barrel without the plurality of weights.

4. A percussion instrument comprising:

a substantially cylindrical barrel;

a weight provided with magnetic power fixed to the barrel;

a functional part configured to be attached to the barrel; and a fastening member configured to attach the functional part to the barrel, wherein at least one component, among the barrel, the functional part, and the fastening member, contains iron, and wherein the weight is fixed to the at least one component due to the magnetic power.

5. The percussion instrument according to claim 4, wherein the weight is fixed to at least one of the functional part or the fastening member as a result of the functional part being attached to the barrel using the fastening member.

6. The percussion instrument according to claim 5, wherein:

the weight is fastened to the functional part, and the weight, in a state of being fastened together with the functional part, is fixed to the barrel using the fastening member.

7. The percussion instrument according to claim 4, wherein:

the fastening member comprises at least one bolt, the weight has a hole through which a bolt, among the at least one bolt, is to be inserted, and the weight has a circular shape when seen in the axial direction of the hole, and has rotational symmetry with respect to the axis of the hole.

8. The percussion instrument according to claim 4, wherein the weight is in contact with the barrel at least at two points in the circumferential direction of the barrel, the two points being opposite to each other with respect to the fastening member in the circumferential direction of the barrel.

9. The percussion instrument according to claim 4, wherein:

the fastening member comprises at least one bolt, the weight has a hole through which a bolt, among the at least one bolt, is to be inserted, and the weight has a teardrop shape when seen in the axial direction of the hole, and is disposed so that the lengthwise direction of the weight is substantially parallel to the axial direction of the barrel.

10. The percussion instrument according to claim 9, wherein:

the weight includes a protrusion protruding toward the barrel, and the protrusion is in contact with the barrel when the weight is fixed to the functional part with the bolt inserted into the hole.

11. The percussion instrument according to claim 4, wherein:

the weight fixed to the barrel is provided as one or more weights, and the total mass of the one or more weights fixed to the barrel is greater than 25% of the mass of the barrel without the one or more weights.

12. The percussion instrument according to claim 4, wherein the functional part is a lug.

13. The percussion instrument according to claim 1 wherein each of the plurality of weights is columnar shaped that is sufficiently short compared to an inner diameter of the barrel.

14. The percussion instrument according to claim 7, wherein the weight includes a release hole that is greater than the hole through which the bolt is to be inserted.

15. A weight configured to be fixed to a percussion instrument including a substantially cylindrical barrel, the weight comprising:

a weight body including a hole through which a bolt is to be inserted and having a teardrop shape when seen in the axial direction of the hole, wherein the weight body is configured to be fixed to the barrel with the bolt inserted into the hole so that the lengthwise direction of the weight is substantially parallel to the axial direction of the barrel, wherein the weight body includes a protrusion protruding toward the barrel, and wherein the protrusion is in contact with the barrel when the weight is fixed to barrel with the bolt.

* * * * *